United States Patent [19]

Leaver

[11] 4,260,087

[45] Apr. 7, 1981

[54] BELT BUCKLE HOLSTER

[76] Inventor: Samuel L. Leaver, 3212 Alta Dr., Las Vegas, Nev. 89107

[21] Appl. No.: 61,746

[22] Filed: Jul. 30, 1979

[51] Int. Cl.[3] ..... A45C 11/00

[52] U.S. Cl. ..... 224/163; 24/163 K; 42/1 E; 224/248; 224/912; D2/406

[58] Field of Search ..... 224/163, 224, 225, 248, 224/912; 24/2.5, 3 R, 3 F, 3 J, 3 L, 163 R, 163 FL, 163 K, 163 KO; 42/1 R, 1 J, 1 K, 54, 58; 46/1 E; 211/64; D2/400, 406, 407; D22/13, 14

[56] References Cited

U.S. PATENT DOCUMENTS

| | | | |
|---|---|---|---|
| D. 251,339 | 3/1979 | Tulak | D2/406 |
| 252,448 | 1/1882 | Flatau | 224/912 |
| 3,026,642 | 3/1962 | Ryan | 46/1 E X |
| 3,060,625 | 10/1962 | Glass et al. | 42/54 X |
| 3,353,728 | 11/1967 | Freed | 224/912 |
| 4,096,979 | 6/1978 | Collins | 224/163 |

OTHER PUBLICATIONS

American Rifleman, Feb. 1954, pp. 26 & 27, "In my Arms Collection".

Playthings, Mar. 1960, vol. 58, No. 3, p. 24 "Panther Pistol".

*Primary Examiner*—Stephen Marcus

*Attorney, Agent, or Firm*—Seiler & Quirk

[57] ABSTRACT

A Western-style belt buckle is a metal plate having a small pistol mounted thereon. The pistol is part of the ornamentation of the buckle, but is releasably mounted on the buckle in a manner permitting quick removal. An aperture in the plate permits the wide, bullet chamber portion of the pistol to extend through the plate, providing a compact unit. The gun is fastened to the plate with a spring clip and a barrel retainer.

1 Claim, 5 Drawing Figures

BELT BUCKLE HOLSTER

BACKGROUND OF THE INVENTION

This invention relates to an ornamental belt buckle which also carries a small pistol. When the pistol is in place, it forms a part of the ornamental decoration of the belt buckle. If necessary, the pistol can be easily and quickly removed from the buckle for use.

It has been common practice for many years, praticularly in the Western United States, for people to wear large, ornate belt buckles to fasten leather belts. These buckles might be quite large in size, often approaching up to 3"×5", and carry ornate figures, lettering, and semi-precious stones such as turquoise.

It has also been known to design holsters for small pistols in many different ways. In general, however, these holsters have been designed to be hidden from ordinary view when worn by the user. For example, shoulder holsters were used to hide a pistol inside a wearer's clothes, as were holsters which were strapped to the ankle or thigh.

It is a purpose of the present invention to provide a large belt buckle which is ornamental and which includes a small pistol as a part of the ornamental design of the holster. In addition to the esthetic qualities of the buckle, the buckle serves the useful function of a holster from which the pistol may be quickly removed if necessary.

SUMMARY OF THE INVENTION

A belt buckle comprises a plate portion, an aperture in the plate portion to receive a portion of a small pistol, and mounting means for the pistol on the plate portion comprising a barrel retainer and spring clip means for securing the pistol to the plate.

BRIEF DESCRIPTION OF THE DRAWINGS

The invention is best understood with reference to the drawings, in which.

DETAILED DESCRIPTION OF A PREFERRED EMBODIMENT

Figure 1:
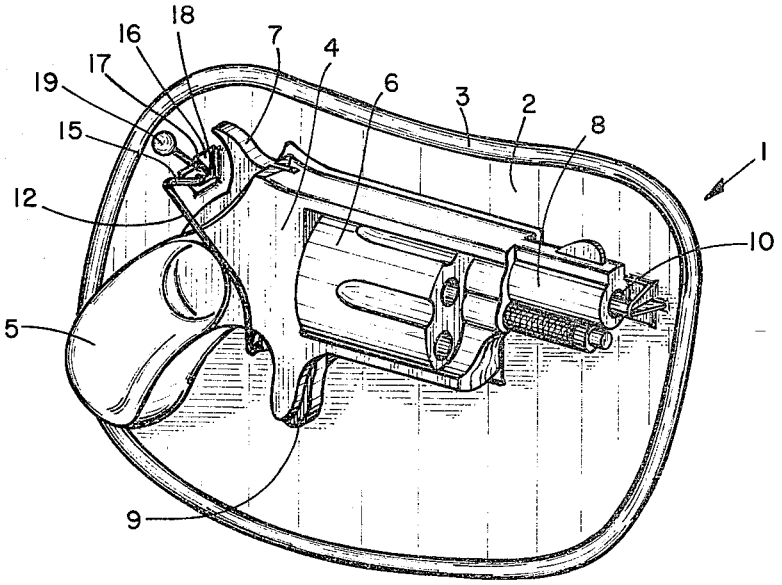
FIG. 1 is a perspective front view of a buckle of the invention with the pistol in place thereon.
Figure 2:
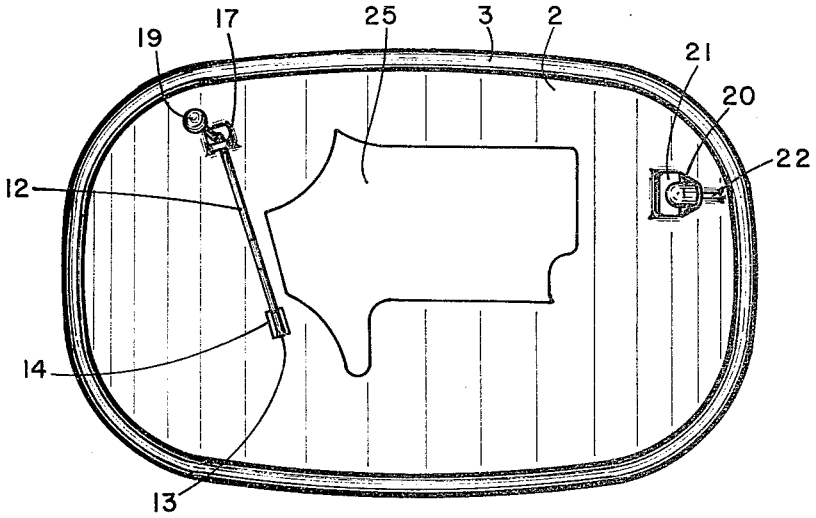
FIG. 2 is a front elevational of the buckle with the pistol removed.

Referring to FIG. 1, belt buckle 1 comprises a slightly convex plate portion 2 which serves attaches to a mounting bracket 16. The mounting bracket has a flat base welded to plate 2 and an outwardly extending, hook-shaped catch 17 having an opening 18 under which the wire clip can slide. When the pistol is in place, as shown in FIG. 1, the elongate portion of clip 12 abuts the gun grip and the outward pressure on the clip creates an inward bias, thereby firmly attaching the upper portion 15 of the clip securely in the hook-shaped catch 17. To release the catch, the user presses on the ball 19 at the end of the catch, simultaneously pushing the ball toward the opening 18 at the end of the hook, thereby releasing the spring clip from the catch.

The other cooperative portion of the mounting means for the pistol in the embodiment of FIG. 1 is a rearwardly extending lug 20 mounted on a base 21 which is welded to the forward portion of the plate. A flange 22 is used to strengthen the lug support. The lug engages the bore 10 in the barrel 8 of the gun as shown in FIG. 1, thereby preventing any motion of the gun in a forward, upward, or downward direction when the clip is in place.

In the embodiment of the invention shown in FIG. 1, the buckle is slightly convex, i.e., rounded to the contour of the wearer's abdomen. Since the gun is flat, and since the middle portion thereof is relatively wide, an aperture 25 is cut into the plate to receive as a mounting base for pistol 4. The plate is surrounded by decorative edging 3, and may also have a variety of other decorative features, such as turquoise nuggets, which are not shown in the drawing. The pistol has a grip member 5, a revolving cylinder 6 containing bullet chambers, a hammer 7 for operating the firing pin, a barrel 8, and a trigger 9. The pistol is conventional and may be used in the buckle of the invention without modification; an appropriate model is North American Arms Model NAA 22LR (0.22 caliber) pistol. Alternatively, Sterling Automatic Model No. 300 (0.25 caliber) or Model 302 (0.22 caliber) may also be used. These pistols are approximately 4" long and 2" high.

The pistol is mounted on the plate member in a manner such that it is sufficiently secured to the plate to avoid accidental disengaging, yet may be rapidly removed if desired for instant accessibility. In the embodiment shown in FIG. 1, the mounting means comprises a pivoted spring clip to hold the grip portion and a lug attached to the plate which retains the barrel portion. Spring clip 12 is pivotally mounted on plate 2 by a loop 13 at its lower end which wraps loosely around a pin (not shown) extending across yoke 14, which is welded to the plate. The yoke is simply a U-shaped bracket which holds the end of the wire clip. The upper U-shaped portion of the clip removably the revolving cylinder and adjacent portions of the pistol. Accordingly, the middle portion of the pistol extends slightly (about ¼") in back of the plate. The recessing of a portion of the pistol into the plate permits the pistol to lie relatively flat on the plate, and to appear more to be an integral part of the design of the buckle; however, this slight intrusion is not sufficient to interfere with the utility of the buckle.

Figure 3:
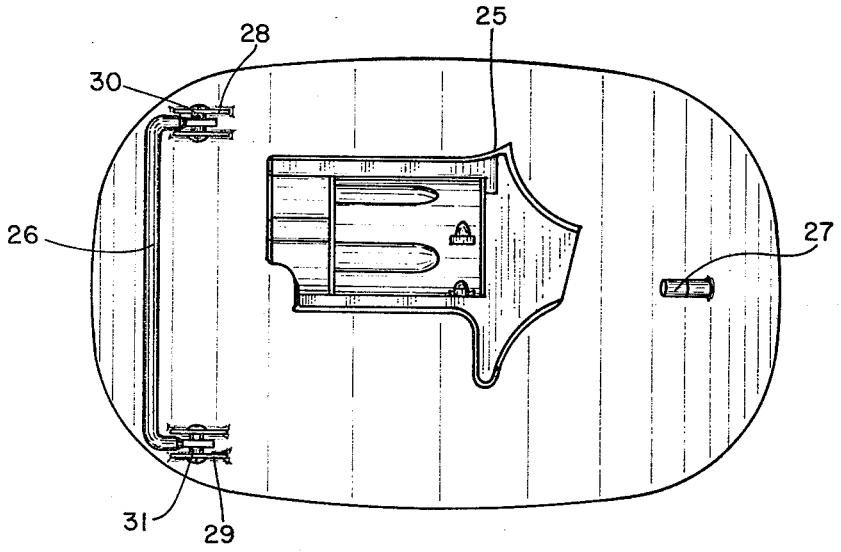
FIG. 3 is a rear view thereof with the pistol in place.

A rear view of the buckle with the pistol in place is shown in FIG. 3. The belt mounting means is conventional and consists of a pivoted loop 26 and a pin 27. The ends of the buckle loop 26 are mounted on yokes 28 and 29 welded to the back of the plate. Pins 30 and 31, respectively, are mounted in the yokes 28 and 29 to mount the loop. In use, one end of the belt loops around the bar 26, and the other end of the belt extends around the body and underneath the bar, with the pin 27, which extends outwardly at an angle from the plate, engaging one of the holes in the belt.

Figure 4:
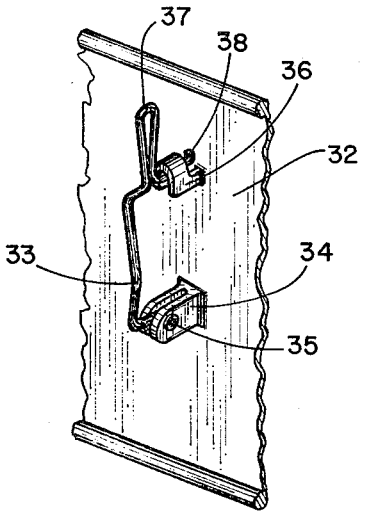
FIG. 4 is a partial view of a different belt buckle of the invention showing a different spring clip retainer.

Another embodiment of a belt buckle of the invention is shown in FIG. 4. In this embodiment, the pistol is mounted on a flat plate 32, and is retained by spring clip 33 having one end thereof pivotally mounted around pin 35 in yoke 34. The spring clip surrounds the body of the pistol in a manner similar to that shown in FIG. 1. A catch 36 mounted on the plate engages a straight lip portion 38 at the end of the clip to secure the clip in place. The clip is removed by pressing inwardly on loop 37, releasing the straight portion 38 of the clip from catch 36. At this point, the clip can be pivoted around the yoke and the gun released.

Figure 5:
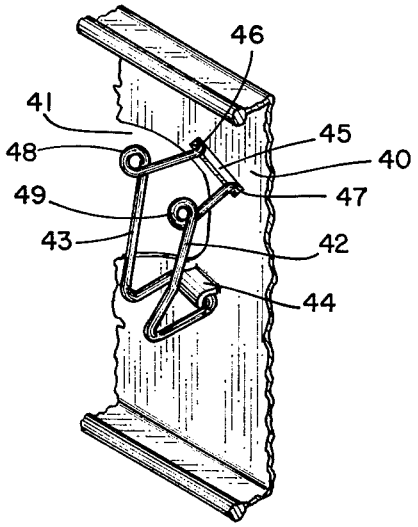
FIG. 5 is a partial view of another different buckle of the invention showing a different spring clip retainer.

Another embodiment of the mounting plate of the invention is shown in FIG. 5. Mounting plate 40 is flat, necessitating a small aperture 41 for the grip portion of the pistol in addition to an aperture (not shown) to accommodate the revolving cylinder. The spring clip in this case comprises a single piece of heavy wire having two arms 42 and 43 which extend through a sleeve 44 welded to the plate. The arms have outwardly extending fingers or flanges 46 and 47 which extend through slot 45 in the face of the plate. To insert or remove the clip, the looped portions 48 and 49 of each arm are squeezed together, thereby permitting the fingers to extend through the slot. When the pistol is in place on the plate, the fingers are held tightly against the rear surface of the plate by the clip, and the pistol is held securely in place.

It will be apparent from the drawings that each of the clips of the invention have a slight knuckle or bend inwardly toward the pistol such that the overlapping portion of the clip directly abuts the pistol surface at one point. To lock the clips into place, force must be used to press against the natural bias of the clip when locking the clip into place. Similarly, to remove the clip from its lock, additional force must be exerted against the bias of the spring before the clip can be removed. This design assures that the gun will not rattle when in place, and also prevents the clip from accidentally coming loose. Nevertheless, with the proper motion against the bias, the user can quickly release the spring clip and the gun will drop into his hand.

Particularly useful material to fabricate the clips for use in buckles of the invention is music wire having a diameter from 0.030 to 0.060 inches, preferably 0.040 to 0.050 inches. Music wire having a diameter of 0.045 inches (20 gauge) is particularly preferred for flexibility, strength, and resiliency.

Other means of releasably mounting the pistol to the plate may be used within the scope of the invention. In principle, any releasable clip or strap-like retaining means could be used. In addition, any barrel retaining apparatus may also be used; for example, in one embodiment of the invention, the barrel of the gun fits underneath a shelf-like ledge which is a portion of the design of the buckle.

Accordingly, while the invention has been described with respect to several specific embodiments of fastening means to retain the pistol in the buckle, the invention should not be considered limited by the foregoing descriptions. Since many modifications may be made within the spirit and scope of the invention, the invention should be limited only by the following claims.

I claim:

1. An ornamental belt buckle comprises a rigid plate, a pistol having a grip portion and a barrel portion mounted on the plate, mounting means to removably secure the pistol to the plate, and attachment means to attach a belt to the buckle, the mounting means comprising releasable fastening means for securing a grip portion of the pistol to the plate, said fastening means consisting of a clip comprising a wire having a diameter of from 0.030" to about 0.060" having one end thereof pivotally connected to the plate, said clip adapted to extend completely over the grip portion of the pistol and to bias the grip portion toward the plate while the pistol is in place on the buckle, latch means for releasably securing another end of the clip to the plate, and retaining means for securing the barrel portion of the pistol to the plate comprising a lug which interconnects with a bore in the barrel.

* * * * *